US007174963B2

(12) United States Patent
Bertelsen

(10) Patent No.: US 7,174,963 B2
(45) Date of Patent: Feb. 13, 2007

(54) DEVICE AND A METHOD FOR DISCONNECTING A TOOL FROM A PIPE STRING

(75) Inventor: Olaf Bertelsen, Ålgård (NO)

(73) Assignee: Bakke Oil Tools, AS, Algard (NO)

( * ) Notice: Subject to any disclaimer, the term of this patent is extended or adjusted under 35 U.S.C. 154(b) by 88 days.

(21) Appl. No.: 10/803,351

(22) Filed: Mar. 18, 2004

(65) Prior Publication Data

US 2004/0216887 A1 Nov. 4, 2004

(30) Foreign Application Priority Data

Mar. 21, 2003 (NO) ..... 20031305

(51) Int. Cl.
*E21B 17/06* (2006.01)

(52) U.S. Cl. ..... 166/376; 166/242.7; 166/377

(58) Field of Classification Search ..... 166/377, 166/376, 242.6, 242.7
See application file for complete search history.

(56) References Cited

U.S. PATENT DOCUMENTS

| | | | | |
|---|---|---|---|---|
| 2,843,399 | A | 7/1958 | Arterbury et al. | |
| 2,988,145 | A | 6/1961 | Clark | |
| 3,753,471 | A | 8/1973 | Kammerer et al. | |
| 3,842,914 | A | 10/1974 | Mott | |
| 4,289,202 | A | 9/1981 | Henderson | |
| 4,449,736 | A | 5/1984 | Blackwell | |
| 4,601,492 | A | 7/1986 | George | |
| 4,915,423 | A | 4/1990 | Wallace | |
| 4,984,632 | A | 1/1991 | Sampa et al. | |
| 5,092,364 | A | 3/1992 | Mullins | |
| 5,127,482 | A | 7/1992 | Rector, Jr. | |
| 5,257,663 | A | 11/1993 | Pringle et al. | |
| 5,398,763 | A * | 3/1995 | Watson et al. | 166/382 |
| 5,419,399 | A | 5/1995 | Smith | |
| 5,526,888 | A | 6/1996 | Gazewood | |
| 5,709,269 | A | 1/1998 | Head | |
| 5,718,291 | A | 2/1998 | Lorgen et al. | |
| 5,787,982 | A | 8/1998 | Bakke | |
| 5,810,088 | A | 9/1998 | Lamirand et al. | |
| 5,984,029 | A | 11/1999 | Griffin et al. | |
| 6,053,262 | A | 4/2000 | Ferguson et al. | |
| 6,131,953 | A | 10/2000 | Cojnnell et al. | |
| 6,186,249 | B1 | 2/2001 | Bjornstad | |
| 6,213,206 | B1 | 4/2001 | Bakke | |

(Continued)

FOREIGN PATENT DOCUMENTS

| | | |
|---|---|---|
| GB | 2 312 074 | 7/1998 |

(Continued)

OTHER PUBLICATIONS

Translation of Norwegian Search Report and Citations, dated Aug. 25, 2003 from NO 2003 1305.

(Continued)

*Primary Examiner*—Hoang Dang
(74) *Attorney, Agent, or Firm*—Patterson & Sheridan, LLP

(57) ABSTRACT

A disconnection device for disconnecting a tool and a pipe string comprises a first connection part releasably connected to a second connection part by means of a locking device and a release object. The release object is soluble by means of, for example, acid.

18 Claims, 5 Drawing Sheets

U.S. PATENT DOCUMENTS

| | | | | |
|---|---|---|---|---|
| 6,276,457 | B1 | 8/2001 | Moffatt et al. | |
| 6,318,470 | B1 | 11/2001 | Chang et al. | |
| 6,408,946 | B1 | 6/2002 | Marshall et al. | |
| 6,439,305 | B1 | 8/2002 | Bakke | |
| 6,450,541 | B1 | 9/2002 | Bakke | |
| 6,474,701 | B1 | 11/2002 | Bowles et al. | |
| 6,629,563 | B2 | 10/2003 | Doane | |
| 6,755,249 | B2 * | 6/2004 | Robison et al. | 166/262 |
| 6,908,118 | B2 | 6/2005 | Fumioka | |
| 6,923,256 | B2 | 8/2005 | Parker | |
| 2004/0045704 | A1 | 3/2004 | Bowles | |

FOREIGN PATENT DOCUMENTS

| | | |
|---|---|---|
| GB | 2 334 047 | 8/1999 |
| GB | 2 355 050 | 4/2001 |
| GB | 2 361 727 | 10/2001 |
| WO | WO 97/29270 | 8/1997 |
| WO | WO 98/30823 | 7/1998 |
| WO | WO 98/32946 | 7/1998 |
| WO | WO 01/16456 | 3/2001 |

OTHER PUBLICATIONS

EP Search Report, Application No. EP04100276, dated Jul. 9, 2004.

* cited by examiner

DEVICE AND A METHOD FOR DISCONNECTING A TOOL FROM A PIPE STRING

CROSS-REFERENCE TO RELATED APPLICATIONS

This application claims benefit of Norwegian patent application serial number NO 20031305, filed Mar. 21, 2003, which is herein incorporated by reference.

BACKGROUND OF THE INVENTION

1. Field of the Invention

This invention concerns a device and a method to enable disconnection of a tool and a pipe string. More particularly, it concerns a disconnection device to be used especially in connection with coiled tubing operations, in which the connection part attached to the pipe string is of an external transverse dimension that may be equal or smaller than that of the pipe string. The invention also comprises a method of effecting the disconnection.

During coiled tubing operations, and especially when using a coiled tubing in for example a borehole, a tool attached to the pipe string may become solidly stuck in the borehole to a degree rendering the pipe string useless for pulling it loose.

Pipe strings are commonly provided with a disconnection device enabling disconnection of the tool and the pipe string, after which the pipe string and the disconnected part of the tool may be retrieved from the borehole. The tool may subsequently be pulled up using fishing tools.

Known disconnection devices are generally formed with a transverse dimensions larger than that of the pipe strings onto which they are attached. Due to this situation, there can be a problem pulling the part of the connection device connected to the pipe string through restrictions located close to the surface. In the past, this problem as been solved for instance through the use of an explosive charge that is introduced into the pipe string immediately above the connection, after which the connection device part is disengaged through blasting from the pipe string. The pipe string then may be pulled up to the surface.

Prior to the positioning of the charge, any hydraulic lines and cables present in the pipe string have to be disconnected and retracted to the surface.

2. Description of the Related Art

The object of the invention is to remedy the disadvantages associated with the prior art.

The object of the invention is achieved through features disclosed in the specification below and in the subsequent claims.

In accordance with one aspect of the present invention there is provided a disconnection device for disconnecting a tool and a pipe string, the device comprising a first connection part releasably connected to a second connection part by means of a locking device and a release object, wherein at least a section of the release object is soluble.

At least in preferred embodiments, a first connection part having an outer transverse dimension equal to or less that that of the pipe string is connected, possible via intermediate parts, to the lower end section of the pipe string. By means of an axially split connector ring of known type, the first connection part is releasably connected to a second connection part. The second connection part is connected, possible via intermediate parts, to a tool.

The split connector ring is maintained in its locking position by means of a pre-stressed locking object aimed in the direction of opening, a release object preventing the locking object from shifting away form its locking position.

At least in preferred embodiments, a first connection part having an outer transverse dimension equal to or less than that of the pipe string is connected, possible via intermediate parts, to the lower end section of the pipe string. By means of an axially split connector ring of known type, the first connection part is releasably connected to a second connection part. The second connection part is connected, possible via intermediate parts, to a tool.

During pipe string operations of the stated type, at least one hydraulic pipe is commonly introduced down to the tool inside the pipe string. By connecting this hydraulic pipe to the release object, the object may be dissolved for instance upon pumping acid down through the hydraulic pipe.

BRIEF DESCRIPTION OF THE DRAWINGS

A preferred embodiment of the invention will now be described by way of example only and with reference to the accompanying drawings, in which.

DETAILED DESCRIPTION OF THE PREFERRED EMBODIMENT

Figure 1:
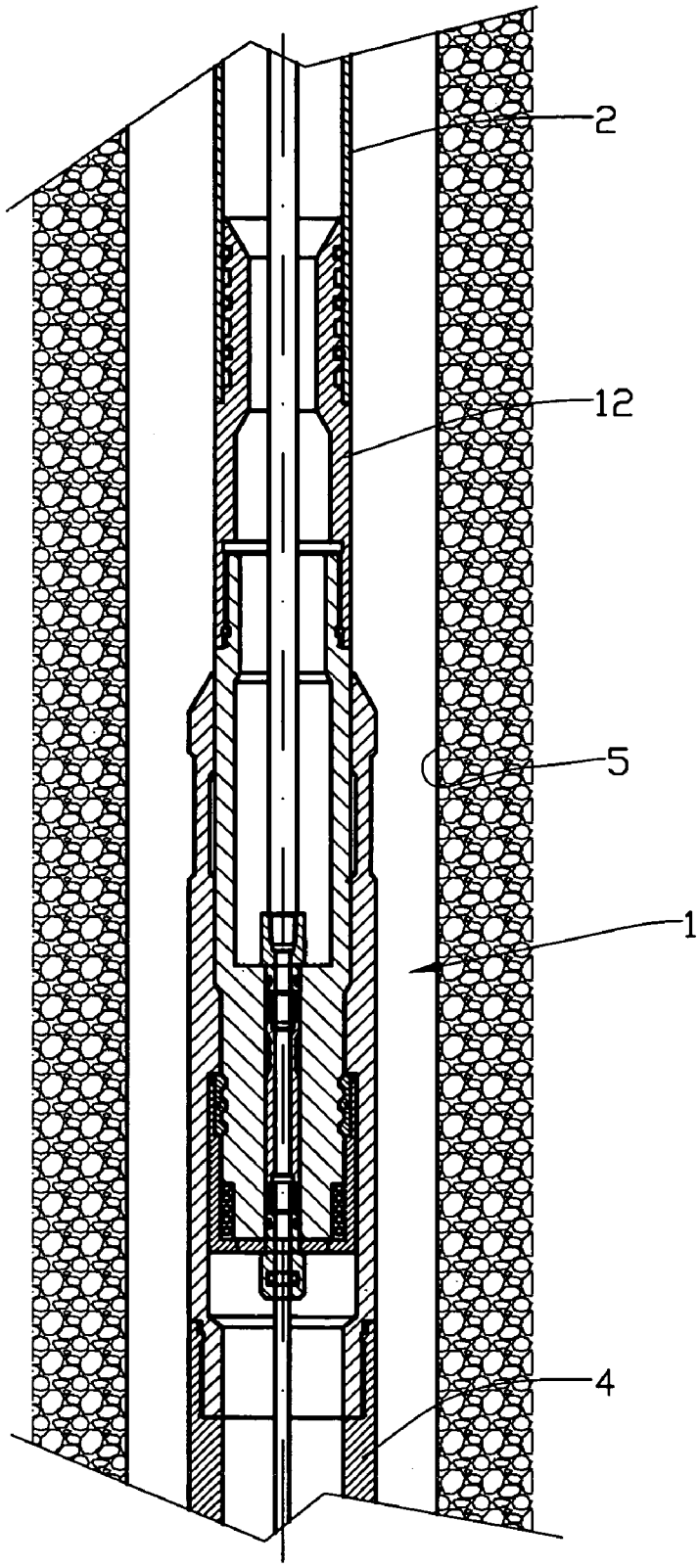
FIG. 1 shows a connector placed between a pipe string and a tool, the assembly being located in a borehole.

In the figures reference numeral 1 denotes a connector that connects a pipe string 2 with a tool 4, all of which are placed in a borehole 5.

The connector 1 consists of a first connection part 6 which is fixedly attached to the pipe string 2, and which is of a design enabling it to be displaced into a second connection part 8 in a releasable and locking manner. The second connection part 8 is fixedly attached to the tool 4.

Figure 2:
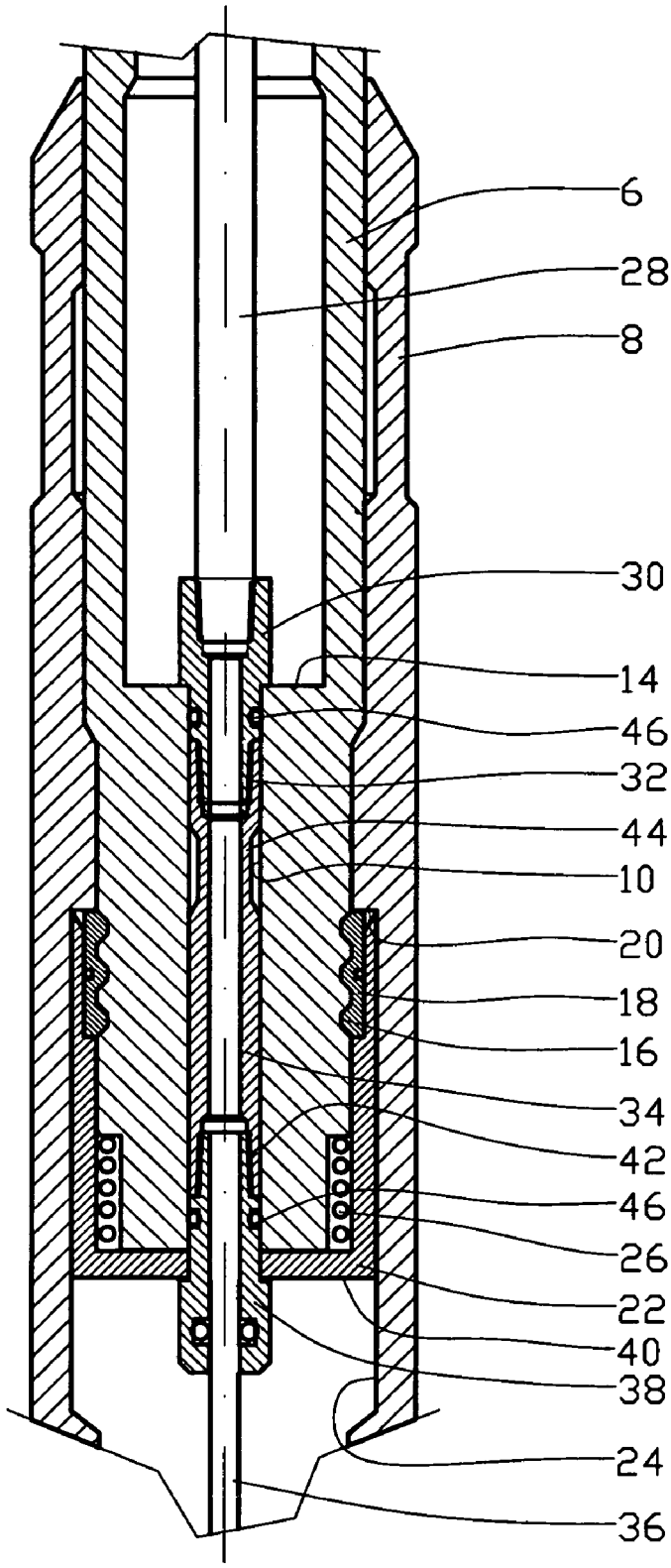
FIG. 2 shows an enlarged view of the connector of FIG. 1, the connector being in its locking position.

The first connection part 6 is provided with a throughgoing bore 10, as shown in FIG. 2. The bore 10 is of a relatively large diameter extending from the lower end section of the first connection part 6 and onwards to a shoulder 14 located between the two end sections of the first connection part 6. The exterior of the first connection part 6 is provided with three encircling grooves 16 matching in a complementary manner an axially split locking ring 18.

Axially the locking ring 18 is positioned against a ledge 20 within the second connection part 8 and is held radially in its locking position by means of a locking sleeve 22 displaced inward and over the locking ring 18. The locking sleeve 22 is displaceably located within a bore 24 of the second connection part 8.

A spring 26 for displacing the locking sleeve 22 out of its locking position is placed between the locking sleeve 22 and the first connection part 6.

A first hydraulic pipe 28 running through the pipe string 2 is connected to a first coupling nipple 30. The first coupling nipple 30 is positioned against the shoulder 14 and is connected to a tubular release object 34 via threads 32. The releasable object 34 forms a portion of a hydraulic circuit.

A second hydraulic pipe 36 attached to the tool 4 is connected to a second coupling nipple 38. The second coupling nipple 38 is positioned against the end portion 40 of the locking sleeve 22 and is connected to the tubular release object 34 via threads 42.

The release object 34 together with the first coupling nipple 30 and the second coupling nipple 38 thereby prevent the locking sleeve 22 from being displaced out of its locking position.

Upon disengaging the tool 4 from the pipe string 2, acid is pumped down through the first hydraulic pipe 28 and down to the release object 34. Being of a material that is relatively easy to dissolve, for example an aluminium alloy, the release object 34 is partially dissolved after being affected by acid for a period of time. Preferably the release object 34 is provided with a section 44 having reduced wall thickness. The coupling nipples 30, 38 are provided with seals 46 that prevent acid from flowing out of the bore 10 as the acid is pervasively corroding the release object 34.

Figure 3:
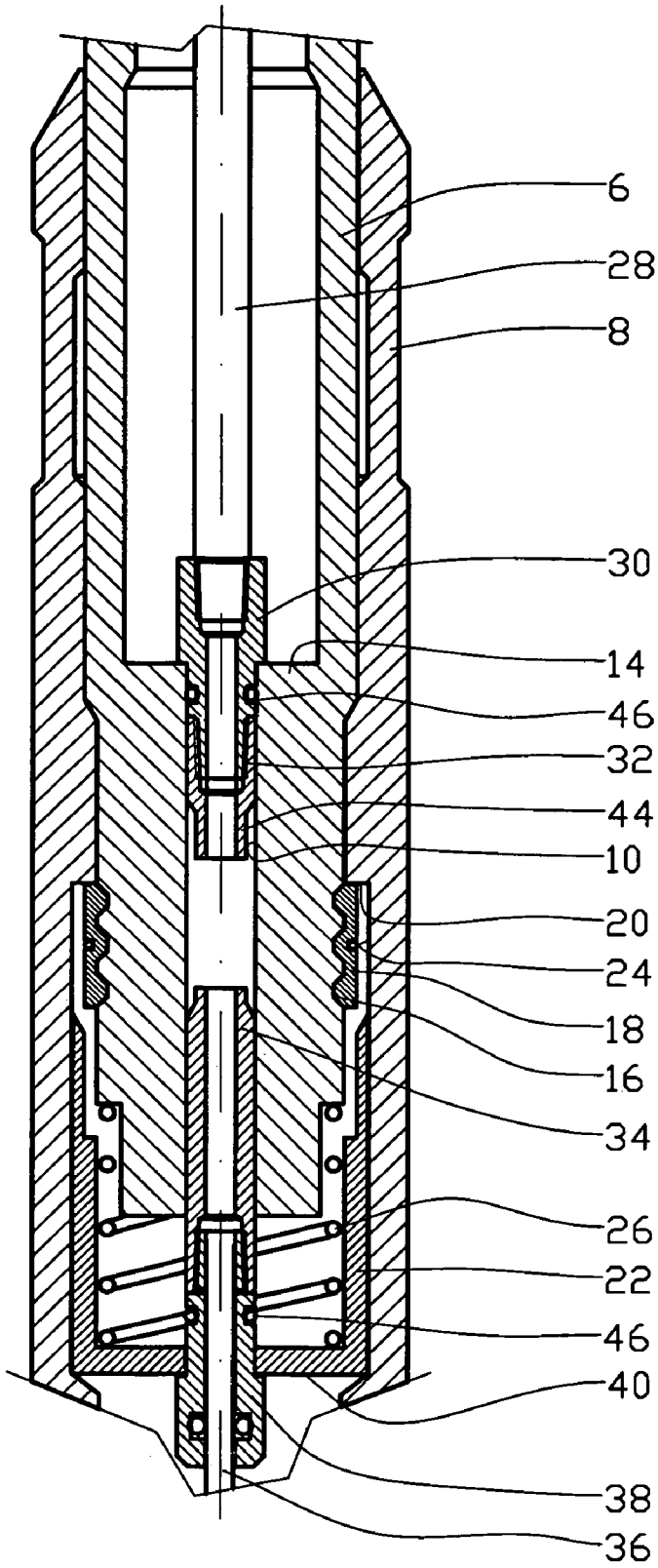
FIG. 3 shows the connector of FIG. 2 when the release object is weakened, thereby causing a spring to displace the locking object away from its locking position.

Having consumed a transverse section of the release object 34, thereby dividing it into at least two parts, the spring 26 displaces the locking sleeve 22 axially and out of its locking position, as shown in FIG. 3.

Figure 4:
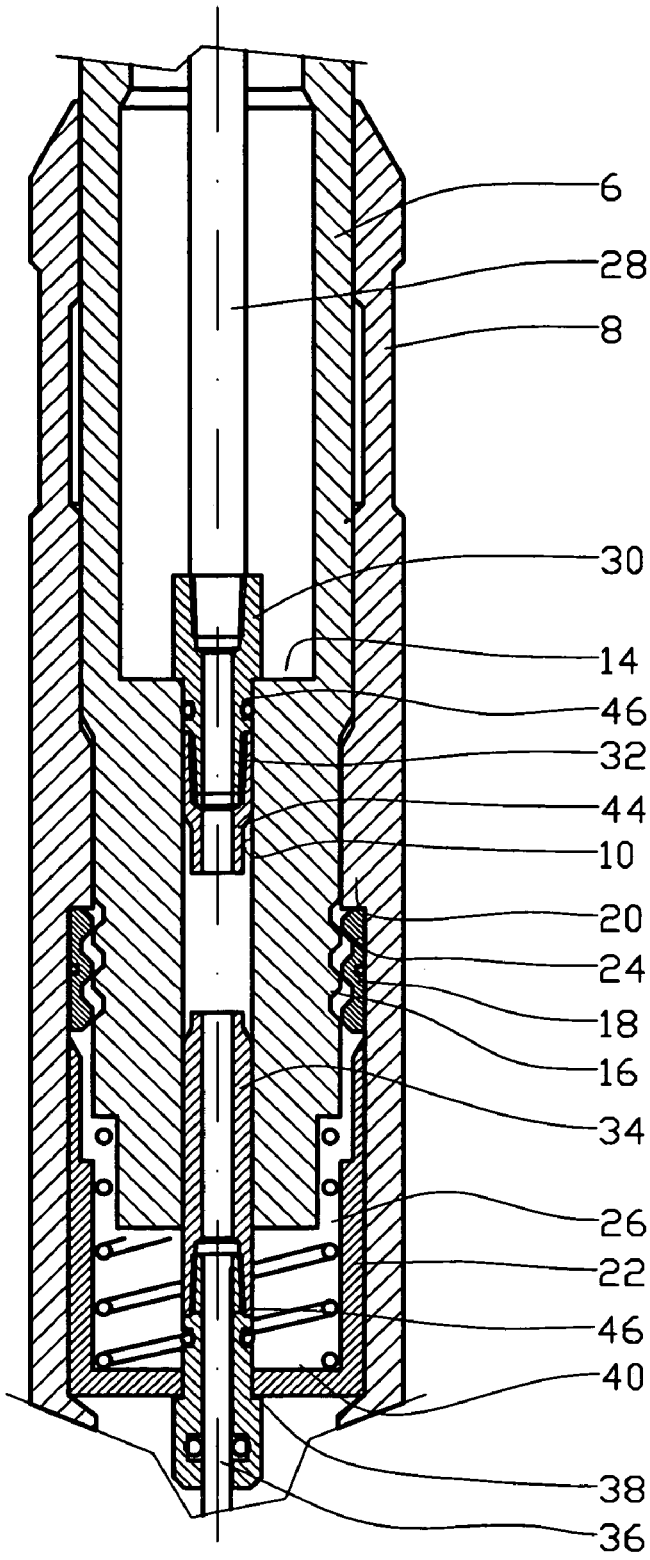
FIG. 4 shows the connector of FIG. 3 when the split connector ring is displaced away from its locking position, and the first connection part of the connector is being displaced away from the second connection part of the connector.
Figure 5:
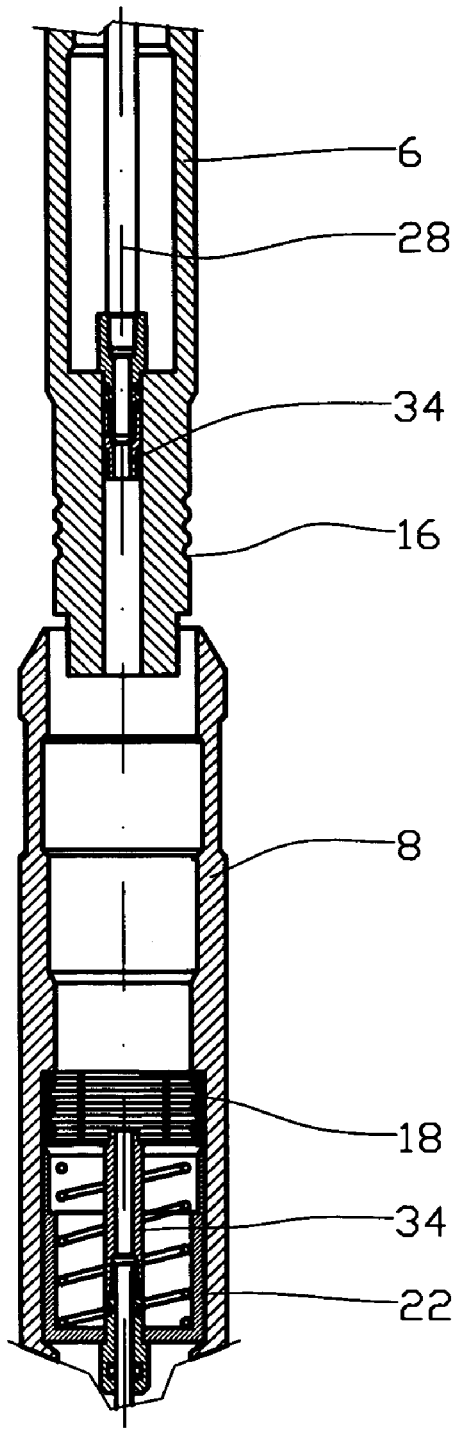
FIG. 5 shows a smaller scale view of the connector in a released position.

Then the axially split locking ring 18 is displaced radially out of the grooves 16 in the first connection part 6 and outwards into the bore 24, as shown in FIG. 4. Thereby the first connection part 6 is released from the second connection part 8, and the connection parts 6, 8 then may be displaced axially and away from one another, as shown in FIG. 5.

It will be appreciated that variations in the above described embodiments may still fall within the scope of the invention, which is set out in the accompanying claims.

The invention claimed is:

1. An apparatus for disconnecting a tool from a tubular string comprising:

a lock;

a lock retainer;

a biasing member for biasing the lock retainer to release the lock; and a dissolvable member configured to retain the lock retainer to maintain the lock in a locked position.

2. The apparatus of claim 1, wherein the lock is a split ring.

3. The apparatus of claim 1, wherein the lock retainer is a sleeve.

4. The apparatus of claim 3, wherein the sleeve couples a first connection portion to a second connection portion.

5. The apparatus of claim 4, wherein the first connection portion is coupled to the tubular string and the second connection portion is coupled to the tool.

6. The apparatus of claim 1, wherein the dissolvable member is coupled to a hydraulic circuit for operating a downhole tool.

7. The apparatus of claim 1, wherein the dissolvable member is a tubular release.

8. The apparatus of claim 7, further comprising a weak section of the release.

9. The apparatus of claim 8, wherein the weak section consists of reduced wall thickness.

10. The apparatus of claim 1, further comprising a solution for dissolving the dissolvable member.

11. The apparatus of claim 10, wherein the solution is an acid.

12. The apparatus of claim 1, wherein the biasing member is a spring.

13. A method of disconnecting a tool from a tubular siring comprising:

running a tool into a wellbore, wherein the tool is coupled to the tubular string by:

a lock;

a lock retainer;

a biasing member for biasing the lock retainer to release the lock; and a dissolvable member configured to retain the lock retainer to maintain the lock in a locked position;

flowing a solution through the tubular string;

dissolving at least a portion of the dissolvable member with the solution;

disconnecting the tool from the tubular string by the biasing member moving the lock retainer.

14. The method of claim 13, wherein the solution is an acid.

15. The method of claim 13, wherein a portion of the dissolvable member has a reduced wall thickness in order to facilitate dissolving.

16. The method of claim 13, wherein the lock is a split ring.

17. The method of claim 13, wherein the lock retainer is a sleeve.

18. The method of claim 17, wherein the sleeve couples a first connection portion to a second connection portion.

* * * * *

UNITED STATES PATENT AND TRADEMARK OFFICE

CERTIFICATE OF CORRECTION

PATENT NO. : 7,174,963 B2
APPLICATION NO. : 10/803351
DATED : February 13, 2007
INVENTOR(S) : Olaf Bertelsen It is certified that error appears in the above-identified patent and that said Letters Patent is hereby corrected as shown below:

In Column 4, Claim 13, Line 23, please delete “siring” and insert --string--.

Signed and Sealed this

Seventh Day of August, 2007

JON W. DUDAS
*Director of the United States Patent and Trademark Office*